US005945744A

United States Patent [19]

Dobler et al.

[11] Patent Number: 5,945,744

[45] Date of Patent: Aug. 31, 1999

[54] ARRANGEMENT FOR THE CONTACTLESS TRANSMISSION OF SIGNALS BETWEEN A FIXED AND A ROTARY VEHICLE COMPONENT

[75] Inventors: Klaus Dobler, Gerlingen; Erich Zabler, Stutensee; Anton Dukart, Wörth, all of Germany

[73] Assignee: Robert Bosch GmbH, Stuttgart, Germany

[21] Appl. No.: 09/011,290

[22] PCT Filed: Apr. 25, 1996

[86] PCT No.: PCT/DE96/00723

§ 371 Date: Feb. 11, 1998

§ 102(e) Date: Feb. 11, 1998

[87] PCT Pub. No.: WO97/07487

PCT Pub. Date: Feb. 27, 1997

[30] Foreign Application Priority Data

Aug. 11, 1995 [DE] Germany ..... 195 29 528

[51] Int. Cl.[6] ..... H01F 27/42

[52] U.S. Cl. ..... 307/10.1; 307/104; 340/310.07

[58] Field of Search ..... 307/9.1, 10.1, 307/104; 340/310.07, 870.31; 439/950; 336/DIG. 2; 455/41; 280/731

[56] References Cited

U.S. PATENT DOCUMENTS 5,498,911 3/1996 Bossler et al. ..... 307/10.1

5,515,399 5/1996 Swart ..... 455/41

5,636,863 6/1997 Reid et al. ..... 280/731

FOREIGN PATENT DOCUMENTS 3034735 4/1982 Germany .

OTHER PUBLICATIONS

Eaton Sales Prospectus "Lebow Torque and Force Transducers" (1993).

*Primary Examiner*—Richard T. Elms

*Attorney, Agent, or Firm*—Kenyon & Kenyon

[57] ABSTRACT

In order that a signal can be transmitted without contact from a stationary vehicle part to a rotationally mounted vehicle part, in the case of axial displacement between the parts, provision is made for a rotary transformer having pot-type cores for primary and secondary windings which have L-shaped profiles. These pot-type cores are mounted coaxially inside each other such that one or a plurality of air gaps existing between them run parallel to the rotational axis and are intersected by the magnetic flux radially with respect to the rotational axis. One of the surfaces of the two pot-type cores bordering on the air gaps is provided with a bevel, which tends to decrease the width of the air gap when an axial displacement lengthens the path of the magnetic flux. One of the pot-type cores may include a plurality of ring segments.

4 Claims, 2 Drawing Sheets

ARRANGEMENT FOR THE CONTACTLESS TRANSMISSION OF SIGNALS BETWEEN A FIXED AND A ROTARY VEHICLE COMPONENT

FIELD OF THE INVENTION

The present invention relates to an arrangement for contactless signal transmission between a stationary vehicle part and one that is rotationally mounted with respect thereto, chiefly between a steering wheel fitted with an airbag and a control switch arranged on the chassis, the arrangement being comprised of a transformer whose primary and secondary windings are situated in separate pot-type cores, which rotate, relative to each other, about the rotational axis of the movable vehicle part, the pot-type cores having an L-profile and fitting with each other such that, in each case, the front end of the short limb of one L-profile faces the inner side of the long limb of the other L-profile and, in this context, air gaps arise which the magnetic flux intersects radially to the rotational axis.

In a rotary transformer known from the prospectus of the Eaton company, "Lebow, Torque, and Force Transducer," 1993, the pot-type cores containing the primary and the secondary windings are comprised of rotationally symmetric U-profiles, which are arranged axially one behind the other such that the openings of the U-profiles face each other. In this way, an air gap is formed running transversely to the rotational axis of the transformer, said air gap being intersected by the magnetic flux in the direction of the rotational axis. In this arrangement of the pot-type cores, an axial displacement of the steering wheel on the steering column directly affects the size of the air gap and, as a result, the degree of coupling between the primary and secondary windings. A transmitted signal would therefore be influenced to a great extent by an axial displacement between the transformer's pot-type cores. This known rotary transformer acts both to transmit firing pulses from a control device fixed to the chassis to an airbag arranged in the steering wheel, as well as, in the reverse direction, to transmit diagnostic signals of the airbag firing pellet resistor to the control device. A diagnostic signal of the firing pellet resistor, transmitted to the control device, could thus, as a result of the change in the air gap, deliver incorrect information concerning the operativeness of the airbag.

In contrast to U-profile pot-type cores, if the pot-type cores, as indicated in the introduction, are formed in an L-profile, savings in both cost and weight are possible. Such a rotary transformer having L-profile pot-type cores is known from German Patent No. 19 20 890 and German Patent No. 30 34 735. In axial displacements of the two L-shaped pot-type cores, in relation to each other, the path for the magnetic flux is lengthened, which in turn can lead to interference with a bridging signal from the transformer.

Thus the object underlying the present invention is to indicate an arrangement of the species indicated above, in which an axial displacement between a stationary and a movable vehicle part exerts as little influence as possible on a signal transmitted, without contact, between the two parts.

SUMMARY OF THE INVENTION

In accordance with the present invention, the pot-type cores have an L-profile, said pot-type cores fitting with each other such that, in each case, the front end of the short limb of an L-profile faces the inner side of the long limb of the other L-profile. In this context, the inner sides, in each case, of the long limbs of the L-profile and/or the front ends of the short limbs are beveled in relation to each other such that in an axial displacement of the two pot-type cores, in relation to each other, the air gap between the long and short limbs decreases. In an axial displacement of the two pot-type cores, their air gaps decrease and in so doing compensate for the longer path of the magnetic flux through the pot-type cores. Axial displacement tolerances and fitting tolerances, for instance of a steering wheel on which one of the two pot-type cores is mounted, therefore have only a slight influence on the transmitted signals. To reduce the weight of the transformer, it is expedient that one of the two pot-type cores be comprised of one or a plurality of ring segments.

DETAILED DESCRIPTION OF THE INVENTION

Figure 1:
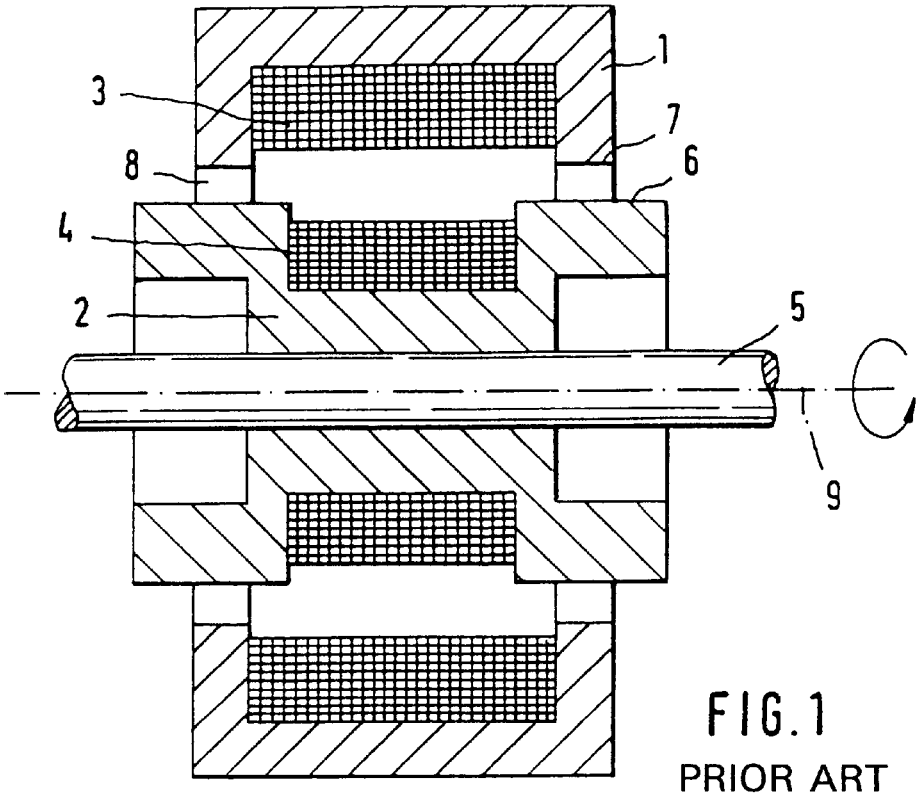
FIG. 1 PRIOR ART
FIG. 1 shows a first variant having U-shaped transformer pot-type cores in accordance with the related art.

FIG. 1 shows a cross section of a ring-shaped transformer having two pot-type cores 1 and 2, arranged coaxially in relation to each other, and designed as U-profiles, of which the one pot-type core 1 carries primary winding 3 and the other pot-type core 2 carries secondary winding 4. Pot-type core 2 for secondary winding 4, for example, is fixed to a steering column 5 of a steering wheel fitted with an airbag. This pot-type core 2 thus constitutes the rotor of a rotary transformer. The stator is pot-type core 1 for primary winding 3; it is immovably fixed to the vehicle chassis. The connections of secondary winding 4 lead to an air bag firing device, not depicted, in the steering wheel, and primary winding 3 is connected to a control device, also not depicted.

The U-profiles of both pot-type cores 1 and 2 face each other, in their openings and in their windings 3 and 4, set therein. Front ends 6 and 7 of both U-profiles 1 and 2 form an air gap 8 between them, which is aligned parallel to rotational axis 9 and is intersected by the magnetic flux in the radial direction to rotational axis 9. As can be seen from FIG. 1, front end 6 of pot-type core 2 is widened in the direction of rotational axis 9 with respect to front end 7 of pot-type core 1. An axial displacement between both pot-type cores 1 and 2 thus does not affect the size of the air gap. Since air gap 8 remains constant despite axial displacement between two pot-type cores 1 and 2, the transmitted signals also remain virtually unaffected by axial displacements.

Figure 2:
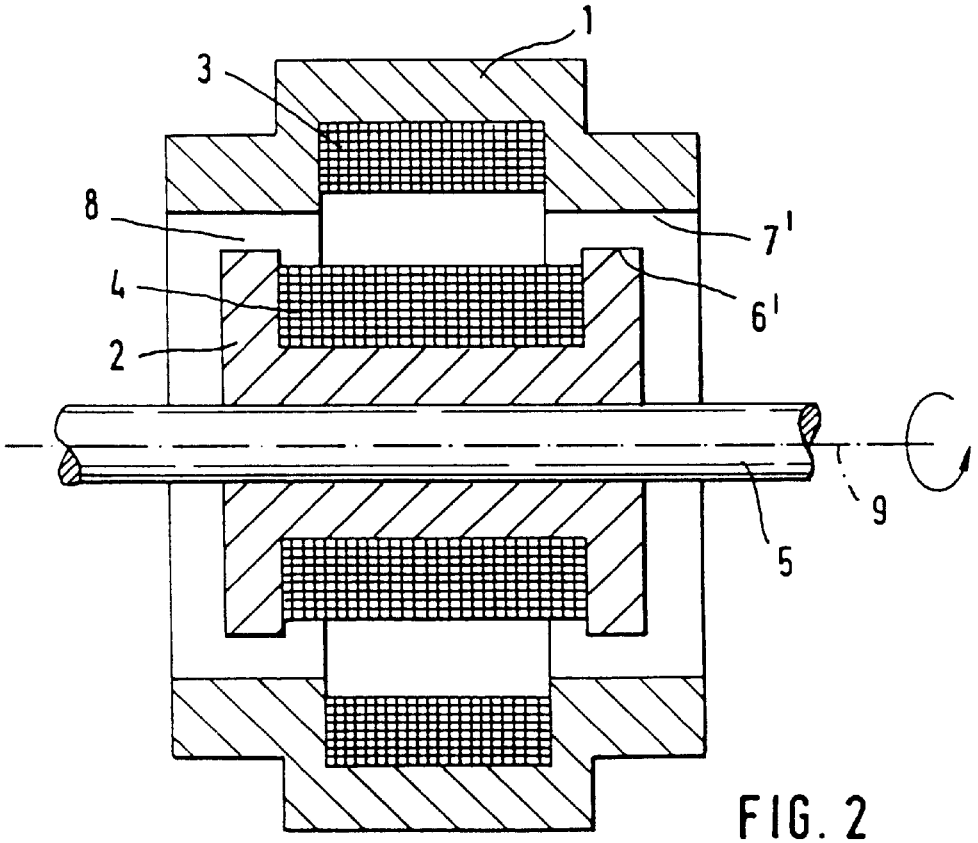
FIG. 2 PRIOR ART
FIG. 2 shows a second variant having U-shaped transformer pot-type cores in accordance with the related art.

As an alternative to the exemplary embodiment in FIG. 1, front end 7' of the primary-side pot-type core 1, in accordance with FIG. 2, can also be widened with respect to front end 6' of the secondary-side pot-type core 2. In so doing, the same effect described above is obtained. It is advantageous that that pot-type core which has the lesser mass of the two be arranged on the steering column.

Figure 3:
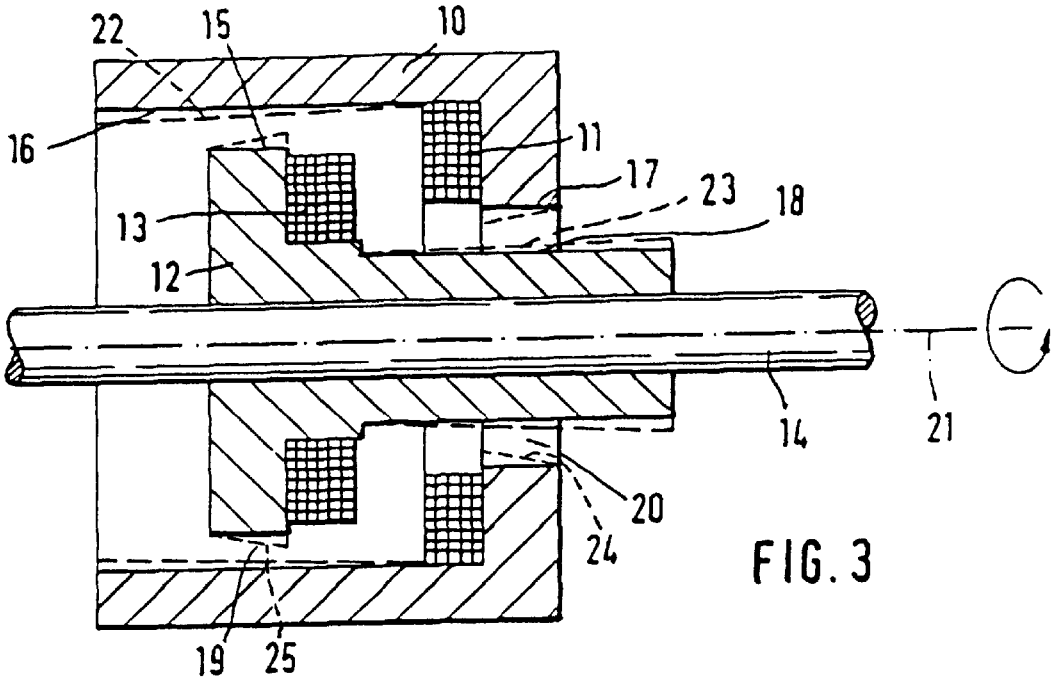
FIG. 3 shows a transformer having L-shaped pot-type cores according to the present invention.
Figure 4:
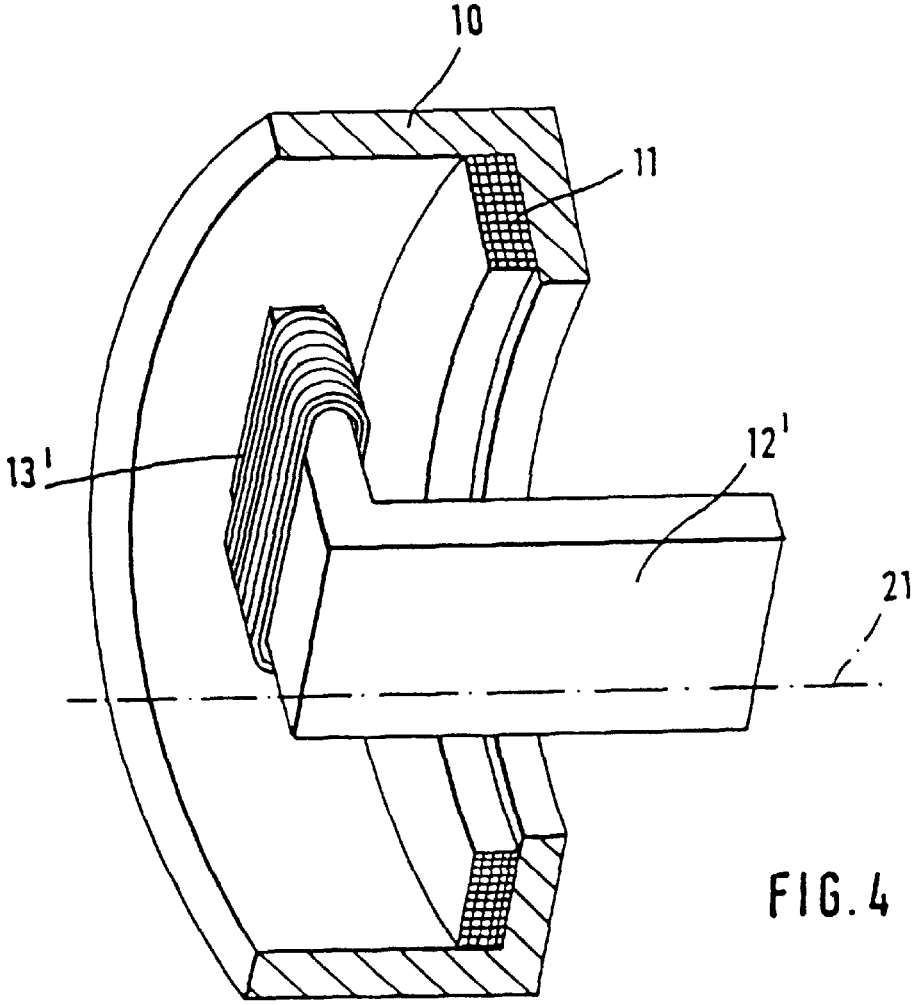
FIG. 4 shows a cut-away portion of a transformer according to the present invention, in which a pot-type core is designed as a ring segment.

FIG. 3 shows a ring-shaped transformer where pot-type core 10 for primary winding 11 and pot-type core 12 for secondary winding 13 are designed as L-profiles. L-profile 12 is secured by its long limb, for instance, to a steering column 14. This pot-type core 12 represents the rotor of the transformer. Pot-type core 10 for primary winding 11, which, as the stator of the transformer, is connected to the vehicle chassis, is arranged in relation to pot-type core 12 such that front end 15 of the short limb of secondary-side L-profile 12 faces inner side 16 of the long limb of primary-side L-profile 10, and that front side 17 of the short limb of primary-side L-profile 10 faces inner side 18 of the long limb of the secondary-side L-profile. In this way, two air gaps 19 and 20 are formed between the individual limbs of L-profiles 10 and 12, the air gaps running in the direction of rotational axis 21 and being intersected by the magnetic flux in a direction radial to rotational axis 21. Because of the fact that here also, as in the exemplary embodiment discussed above, air gaps 19 and 20 are delimited, on the one hand, by a small surface 15, 17, and on the other hand, by a large surface, the air gap width remains virtually unchanged in response to an axial displacement between two pot-type cores 10 and 12.

An axial displacement between two pot-type cores 10 and 12 in such a manner that the distance between secondary winding 13 and primary winding 11 increases, (given a relative permeability of less than 1000) results in the path of the magnetic flux through two pot-type cores 10 and 12 becoming longer, and, consequently, to the signals nevertheless still being influenced a slight amount by an axial displacement of the pot-type cores. Lengthening the path for the magnetic flux can, however, be compensated for by having air gaps 19 and 20 become smaller with increasing axial displacement. This can be achieved, as indicated in FIG. 3 with dotted lines, by providing for a bevel 22 and 23, respectively, for the inner sides of the long limb of L-profiles 10 and 12, the bevel increasing toward the end of the long limb. Instead of, or in addition to, bevels 22 and 23 on the long limbs of L-profiles 10 and 12, provision can be made for corresponding bevels 24 and 25 on the narrower front ends 15 and 17 of the short limbs of L-profiles 10 and 12.

The L-profiles of the pot-type cores yield a significant reduction in weight in comparison with the U-profiles of the first exemplary embodiment. The weight of the transformer can be reduced still more if an L-profile 12', preferably the rotatable pot-type core 12', is merely comprised of one or a plurality of ring segments. Winding 13', belonging to this segmented pot-type core, is wound on the short limb of each L-profile segment.

A rotary transformer, as described above, can generally be used wherever it is necessary for signals from a stationary vehicle part to be transmitted to a vehicle part that is rotatable with respect thereto. Up to now, the application cited has been for an airbag arranged in the steering wheel. As another example, signal transmission can be necessary in door locks having rotationally mounted lock cylinders. As further application areas for the rotary transformer, door hinges or wheels (tire pressure/temperature monitoring) may be mentioned.

If a plurality of signals is to be transmitted between a stationary vehicle part and one that is rotationally mounted with respect thereto, for example, airbag firing and diagnostic signals, or control signals for beepers, radios, or telephones, or even power signals for a steering wheel heating system, then a plurality of transformers as described above can be arranged axially one behind the other, or coaxially, one inside the other.

To avoid eddy currents, it is expedient to manufacture the transformer pot-type cores out of magnetically soft molding compound, which is made of plastic-encased, electrically insulated, very fine iron granules or other ferromagnetic metal granules (e.g., nickel-iron alloys). To avoid any undercutting when molding the pot-type cores, they can be manufactured from a plurality of parts.

What is claimed is:

1. An arrangement for a contactless signal transmission between a stationary vehicle part and a rotationally mounted vehicle part, comprising:

a primary pot-type core having a primary winding of a transformer situated therein, the primary pot-type core having an L-profile;

a secondary pot-type core having a secondary winding of the transformer situated therein, the secondary pot-type core having an L-profile, the primary and secondary pot-type cores rotating in relation to one another about a rotational axis of the rotationally mounted vehicle part, and the primary and secondary pot-type cores arranged with respect to each other so that a front end of a short limb of the primary pot-type core faces an inner side of a long limb of the secondary pot-type core and a front end of a short limb of the secondary pot-type core faces an inner side of a long limb of the primary pot-type core, thereby forming a pair of air gaps therebetween, each of the air gaps being intersected by a magnetic flux radially with respect to the rotational axis;

wherein at least one of the inner side of the primary pot-type core and the front end of the secondary pot-type core is beveled, and wherein at least one of the inner side of the secondary pot-type core and the front end of the primary pot-type core is beveled, so that, in the case of an axial displacement between the primary and secondary pot-type cores, each of the air gaps is reduced.

2. The arrangement according to claim 1, wherein one of the primary and secondary pot-type cores has a shape of a closed ring and the other of the primary and secondary pot-type cores includes at least one ring segment.

3. The arrangement according to claim 1, wherein each of the inner sides and each of the front ends are beveled.

4. The arrangement according to claim 3, wherein one of the primary and secondary pot-type cores has a shape of a closed ring and the other of the primary and secondary pot-type cores includes at least one ring segment.

* * * * *